US012371847B1

(12) United States Patent
Ramsey-Cooper

(10) Patent No.: US 12,371,847 B1
(45) Date of Patent: Jul. 29, 2025

(54) CLEANING SYSTEM FOR CLEANING AN OBJECT

(71) Applicant: Ada Ramsey-Cooper, North Miami, FL (US)

(72) Inventor: Ada Ramsey-Cooper, North Miami, FL (US)

( * ) Notice: Subject to any disclaimer, the term of this patent is extended or adjusted under 35 U.S.C. 154(b) by 233 days.

(21) Appl. No.: 17/976,638

(22) Filed: Oct. 28, 2022

Related U.S. Application Data

(60) Provisional application No. 63/273,305, filed on Oct. 29, 2021.

(51) Int. Cl.
*D06G 1/00* (2006.01)
*D06F 17/04* (2006.01)

(52) U.S. Cl.
CPC ..... *D06G 1/00* (2013.01); *D06F 17/04* (2013.01)

(58) Field of Classification Search
None
See application file for complete search history.

(56) References Cited

U.S. PATENT DOCUMENTS 4,054,209 A * 10/1977 Solomon ..... A47F 7/24 211/208
8,091,747 B2 * 1/2012 Haan ..... D06F 57/02 223/90
9,622,597 B2 * 4/2017 White ..... A47F 5/0006
10,023,984 B2 * 7/2018 Diethart ..... D06F 7/00

FOREIGN PATENT DOCUMENTS

CN 203049329 U * 7/2013

OTHER PUBLICATIONS

CN203049329U translation (Year: 2013).*

* cited by examiner

*Primary Examiner* — Rita P Adhlakha
(74) *Attorney, Agent, or Firm* — John Rizvi; John Rizvi, P.A.—The Patent Professor®

(57) ABSTRACT

A cleaning system is used for cleaning an object, such as a rug, a mat, a runner, a curtain or a cloth, which might be too large for standard washing machines. The cleaning system comprises a supporting apparatus and a cleaning apparatus. The cleaning apparatus is connected with the supporting apparatus. The supporting apparatus comprises a supporting device, a holding device and a transporting device. The holding device is mounted on the supporting device. The transporting device is mounted on the supporting device. The cleaning apparatus comprises a spray device and a manifold device. The spray device is mounted on the supporting device. The spray device and the manifold device are in communication with each other.

18 Claims, 8 Drawing Sheets

CLEANING SYSTEM FOR CLEANING AN OBJECT

CROSS-REFERENCE TO RELATED APPLICATIONS

This application claims the benefit of U.S. Provisional Patent Application Ser. No. 63/273,305, filed on Oct. 29, 2021, which is incorporated herein in its entirety.

FIELD OF THE INVENTION

The present invention relates generally to a cleaning system, and more particularly, to a cleaning system for cleaning an object, such as a rug, a mat, a runner, a curtain or a cloth, which might be too large for standard washing machines.

BACKGROUND OF THE INVENTION

A rug, a carpet, a mat or a runner is a textile floor covering typically consisting of an upper layer of pile attached to a backing. The pile was traditionally made from wool, but since the 20th century, synthetic fibers such as polypropylene, nylon or polyester are often used, as these fibers are less expensive than wool. The pile usually consists of twisted tufts that are typically heat-treated to maintain their structure. The terms rug, carpet, mat or runner are often used in a similar context, but rugs are typically considered to be smaller than a room and not attached to the floor.

A rug, a carpet, a mat or a runner is used for a variety of purposes, including insulating a person's feet from a cold tile or concrete floor, making a room more comfortable as a place to sit on the floor (e.g., when playing with children or as a prayer rug), reducing sound from walking (particularly in apartment buildings), and adding decoration or color to a room. A rug, a carpet, a mat or a runner can be made in any color by using differently dyed fibers. A rug, a carpet, a mat or a runner can have many different types of patterns and motifs used to decorate the surface. A rug, a carpet, a mat or a runner is used in industrial and commercial establishments such as retail stores and hotels and in private homes. Today, a huge range of carpets and rugs are available at many price and quality levels, ranging from inexpensive, synthetic carpets and rugs that are mass-produced in factories and used in commercial buildings to costly hand-knotted wool rugs that are used in private homes.

A rug, a carpet, a mat or a runner can be produced on a loom quite similarly to woven fabric, made using needle felts, knotted by hand (in oriental rugs), made with their pile injected into a backing material (called tufting), flatwoven, made by hooking wool or cotton through the meshes of a sturdy fabric, or embroidered. A rug, a carpet, a mat or a runner is commonly made in widths of 12 feet (3.7 m) and 15 feet (4.6 m) in the US and 4 m (13 ft) and 5 m (16 ft) in Europe. Since the 19th and 20th century, where necessary for wall-to-wall carpet, different widths of carpet can be seamed together with a seaming iron and seam tape (formerly it was sewn together) and fixed to a floor over a cushioned underlay (pad) using nails, tack strips (known in the UK as gripper rods), adhesives, or occasionally decorative metal stair rods. Wall-to-wall carpet is distinguished from rugs or mats, which are loose-laid floor coverings, as wall-to-wall carpet is fixed to the floor and covers a much larger area.

A washing machine is the machine used to wash the various types of clothes, or rug, carpets, mats or runners without applying any physical efforts. With washing machine you don't have to rub the clothes, or rug, carpets, mats or runners with hand or squeeze them to remove the water from them. The washing machine is also called as washer. The washing machine enables you to wash your clothes, or rug, carpets, mats or runners automatically without having to supervise its operation. All you have to do is put the clothes, or rug, carpets, mats or runners in the machine and select the wash mode. The washing machine automatically takes in the amount of water and detergent required and it also automatically sets the timer for washing, rinsing and drying as per the selected mode and the amount of clothes, or rug, carpets, mats or runners. Depending on the position of loading the clothes, or rug, carpets, mats or runners in washing machine, there are two types of washing machines: top loading and front loading washing machines. Top loading washing machine: in this washing machine the clothes, or rug, carpets, mats or runners are loaded from the top of the washing machine. Front loading washing machine: in this machine the clothes, or rug, carpets, mats or runners are loaded from the front side.

However, some clothes, or rug, carpets, mats or runners might be too large for standard washing machines.

Accordingly, there is need for a solution to at least one of the aforementioned problems.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention is related to a cleaning system for cleaning an object, such as a rug, a carpet, a mat, a runner, a curtain or a cloth, which might be too large for standard washing machines.

In an embodiment of the present invention, the cleaning system comprises a supporting apparatus and a cleaning apparatus.

In this embodiment of the present invention, the cleaning apparatus is connected with the supporting apparatus.

In this embodiment of the present invention, the supporting apparatus comprises a supporting device, a holding device and a transporting device.

In this embodiment of the present invention, the supporting device is telescopic.

In this embodiment of the present invention, the supporting device is foldable or collapsible.

In this embodiment of the present invention, the holding device is connected with the supporting device.

Preferably, the holding device is mounted on a top side of the supporting device; additionally, the holding device is further mounted on a bottom side of the supporting device. Additionally or alternatively, the holding device may be mounted on one lateral side or two opposite lateral sides of the supporting device.

In this embodiment of the present invention, the transporting device is connected with the supporting device. Additionally, the transporting device might be foldably mounted on the supporting device.

In an aspect of this embodiment of the present invention, the transporting device comprises at least one wheel. In another aspect of this embodiment of the present invention, the transporting device comprises at least one track. In a further aspect of this embodiment of the present invention, the transporting device is a combination of at least one wheel and at least one track.

In this embodiment of the present invention, the cleaning apparatus is connected with the supporting device.

In an aspect of this embodiment of the present invention, the cleaning apparatus and the transporting device are oppositely located to each other.

In another aspect of this embodiment of the present invention, the cleaning apparatus and the transporting device are adjacently located to each other.

In this embodiment of the present invention, the cleaning apparatus comprises a spray device and a manifold device.

In this embodiment of the present invention, the spray device is mounted on the supporting device.

In this embodiment of the present invention, the spray device and the manifold device are in fluid or gaseous communication with each other.

In this embodiment of the present invention, the spray device might comprise a tube and at least one aperture traversing into the tube.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

These and other objects, features, and advantages of the present invention will become more readily apparent from the attached drawings and the detailed description of the preferred embodiments, which follow.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

The preferred embodiments of the invention will hereinafter be described in conjunction with the appended drawings provided to illustrate and not to limit the invention, where like designations denote like elements, and in which:

Figure 1:
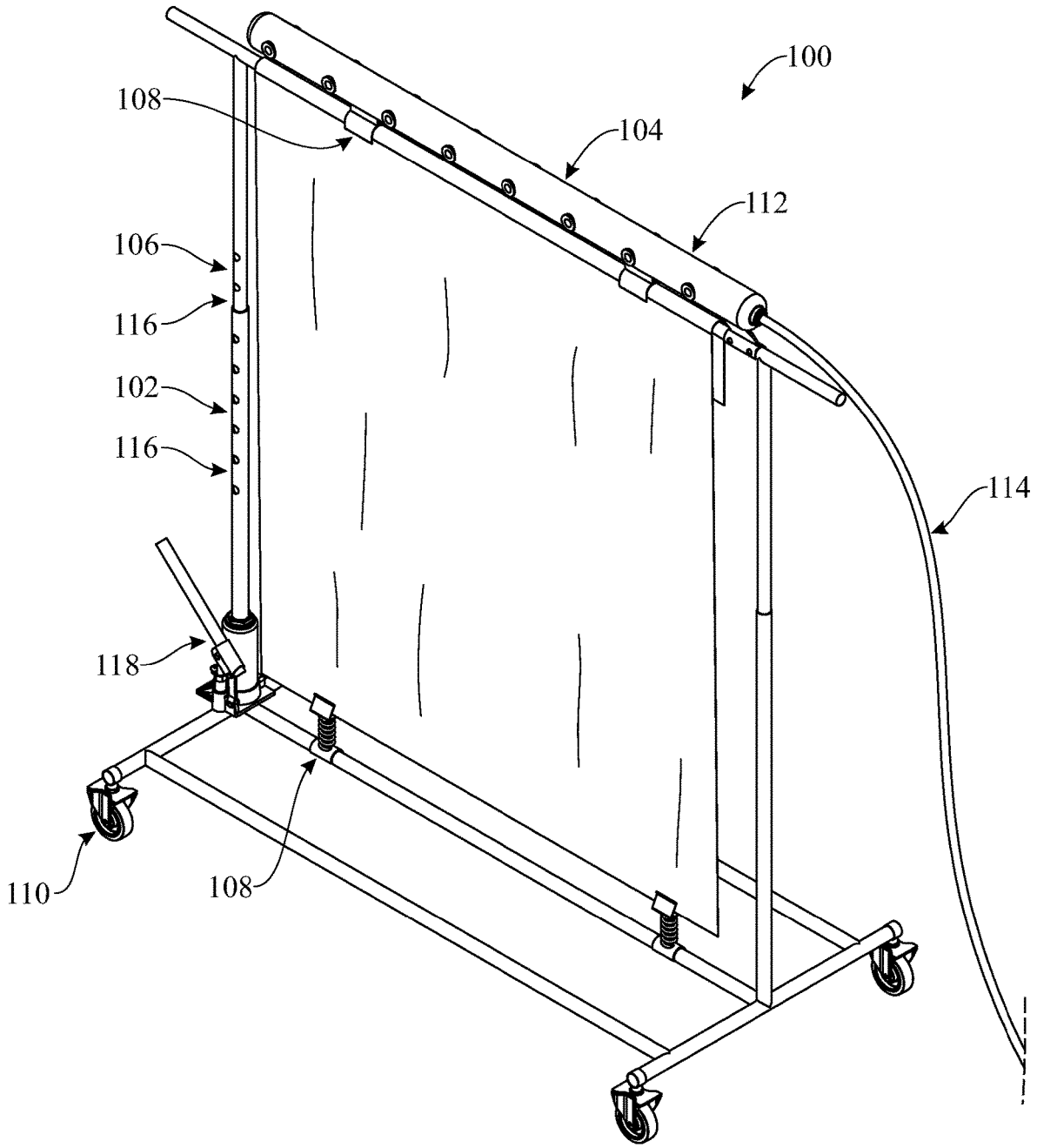
Figure 2:
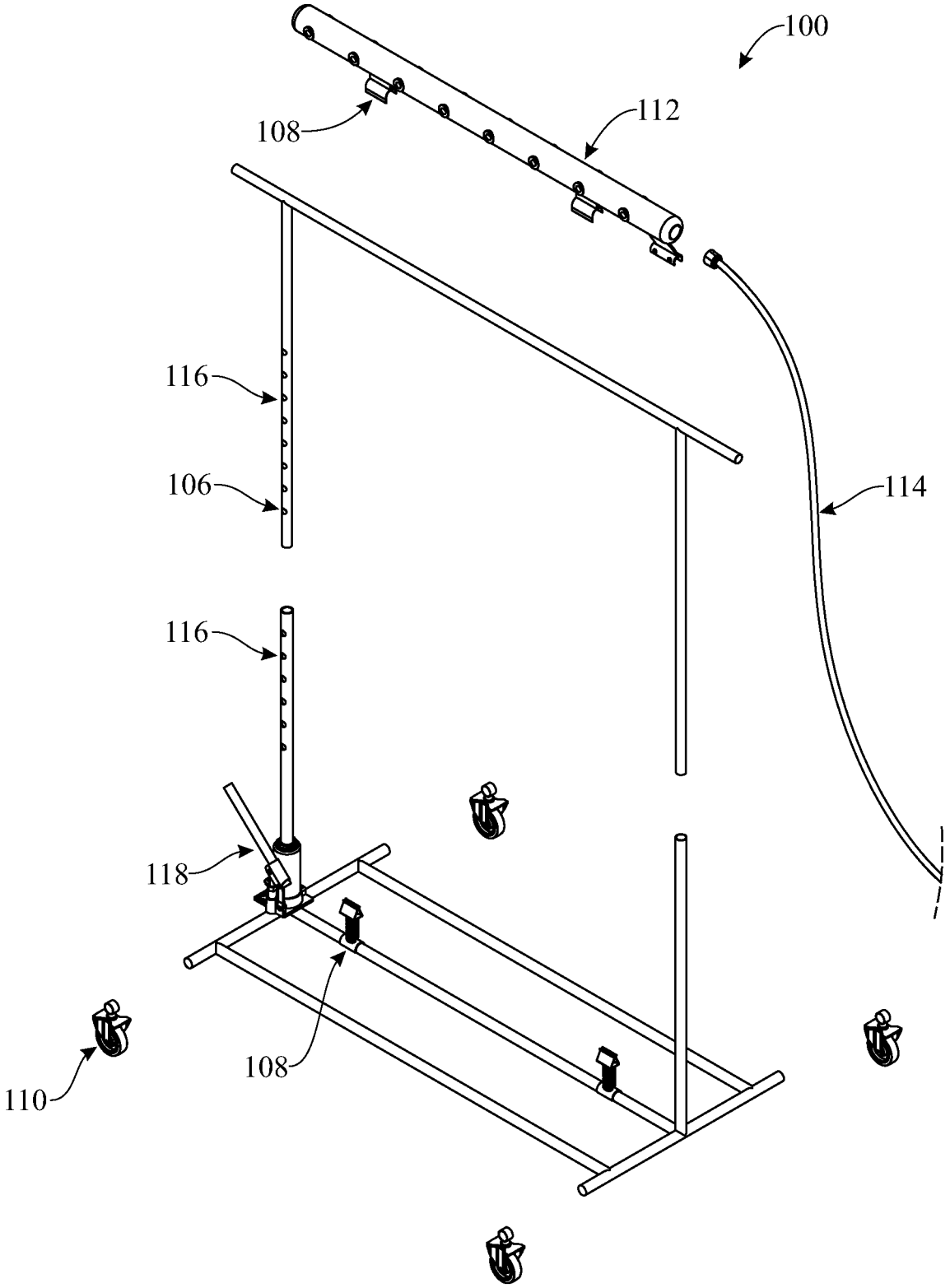
Figure 3:
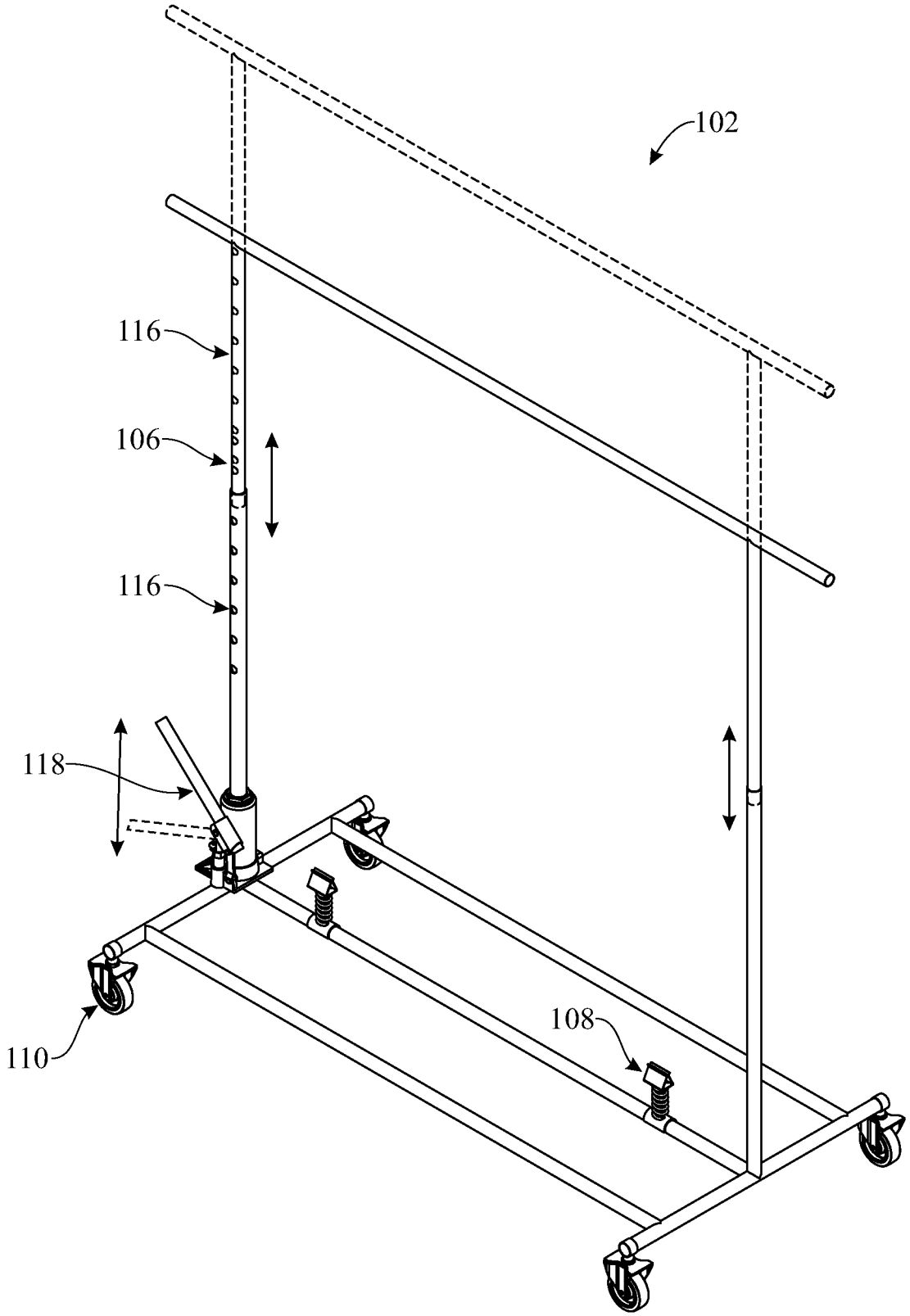
Figure 4:
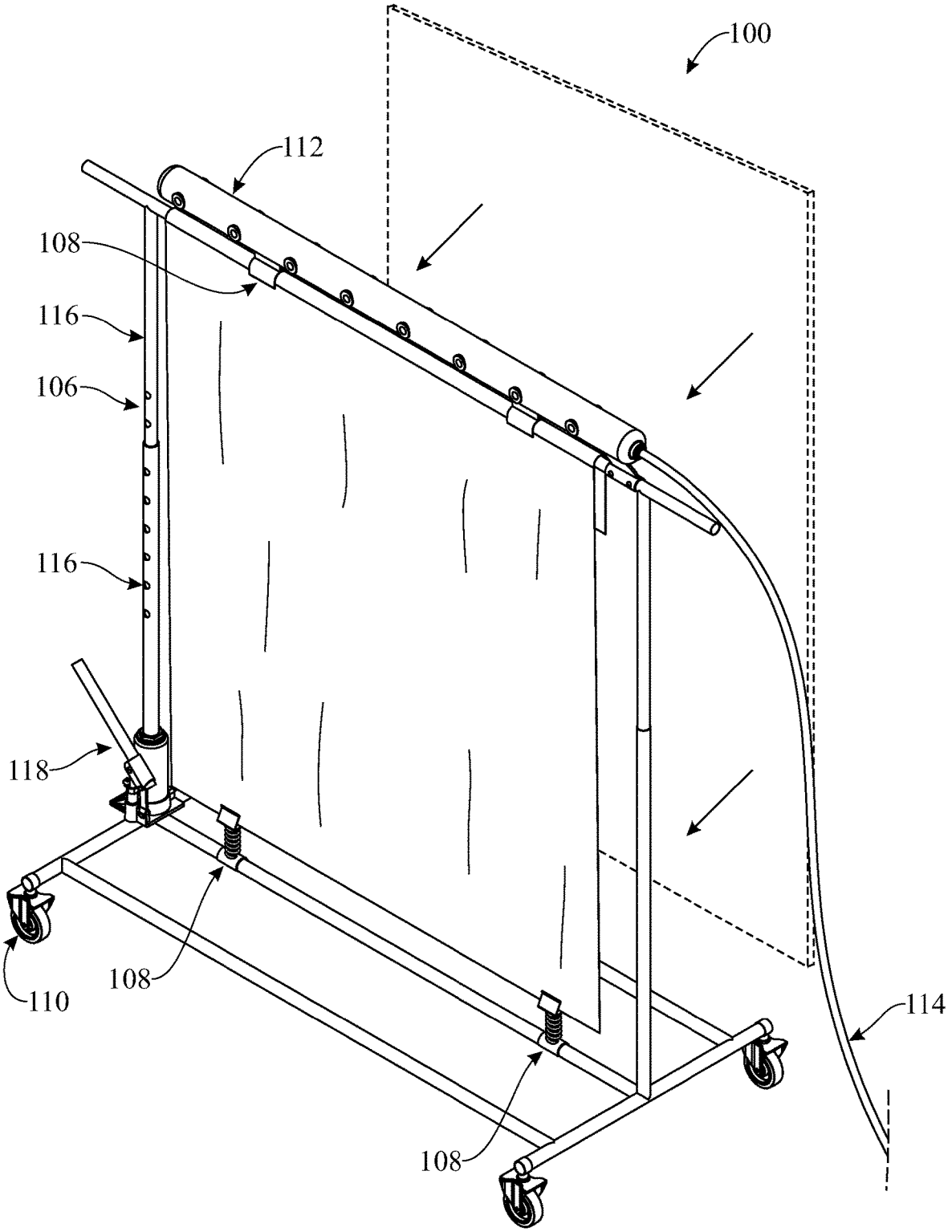
Figure 5:
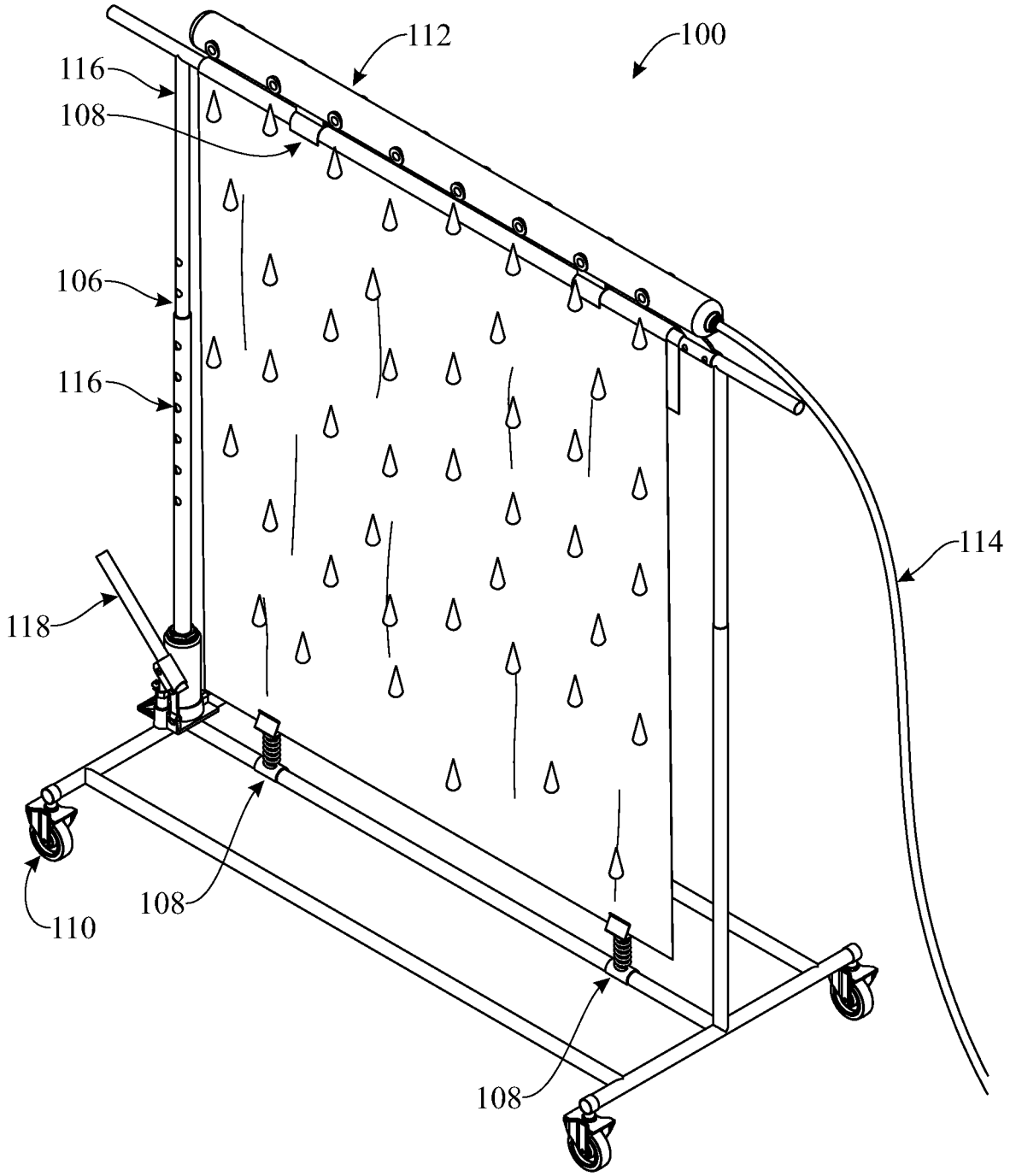
Figure 6:
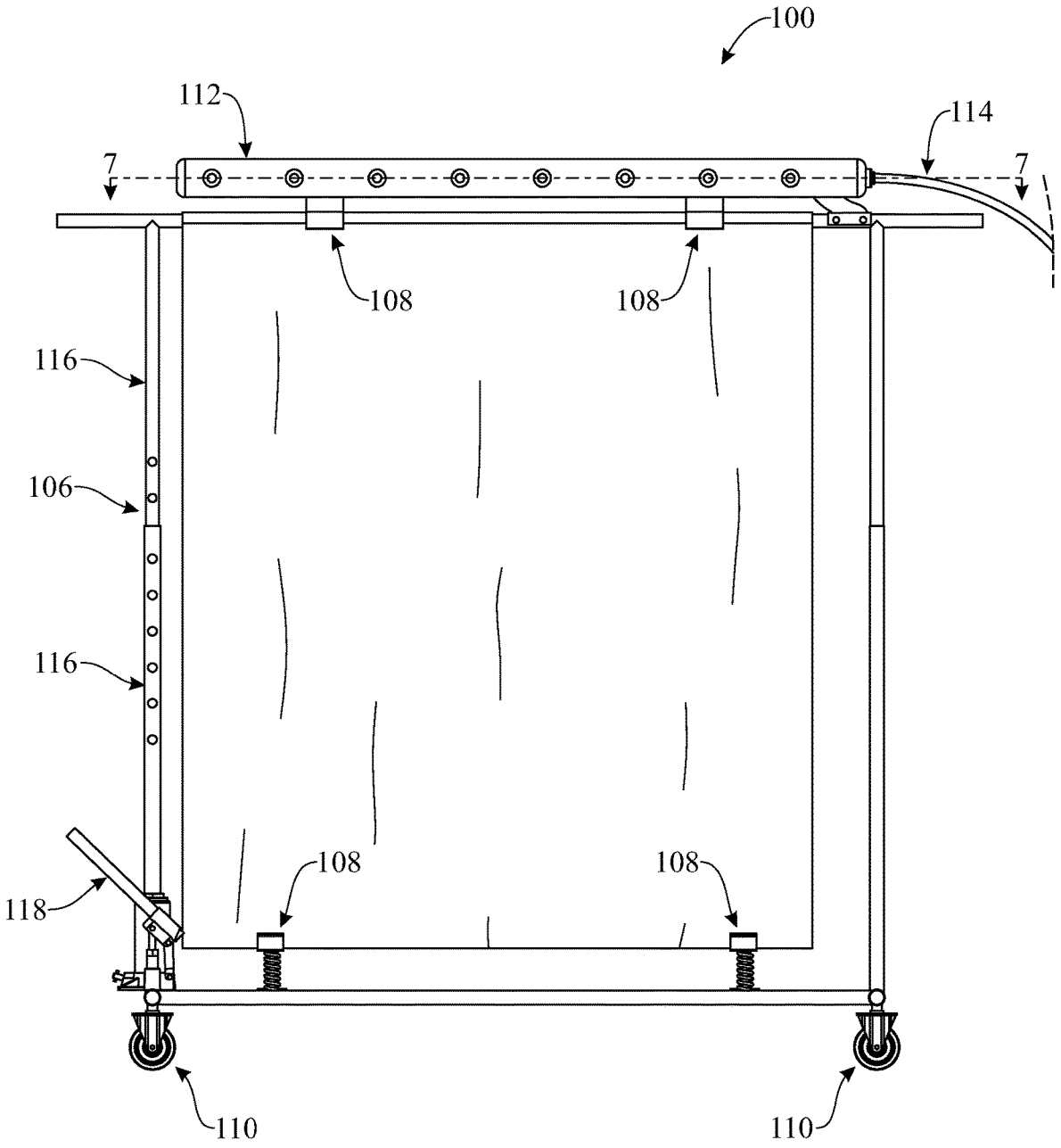
Figure 7:
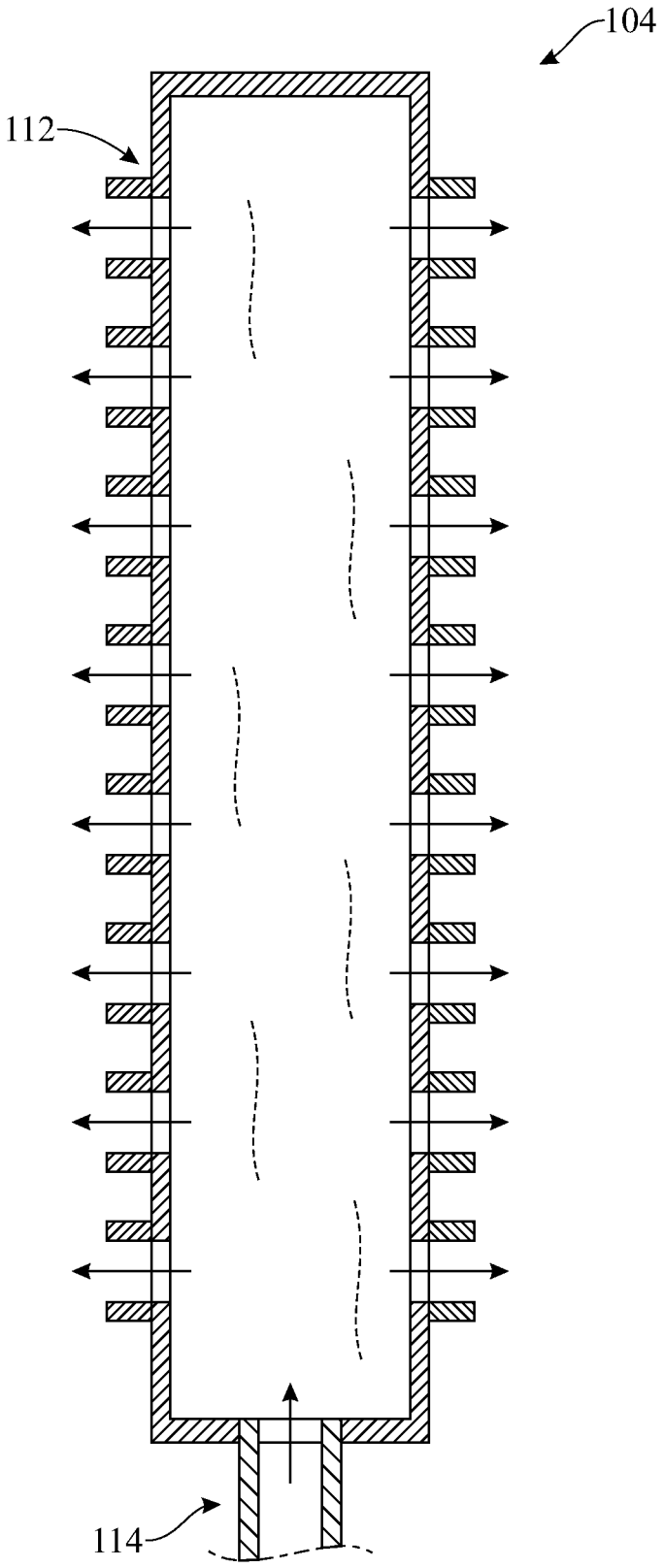
Figure 8:
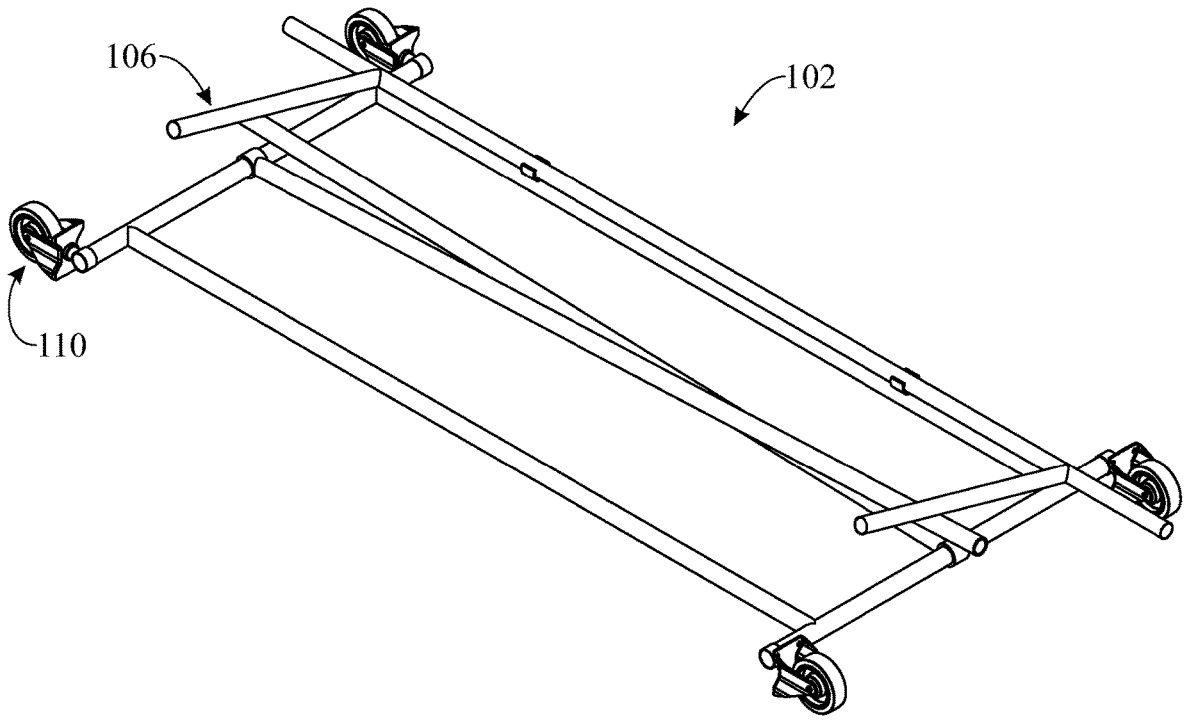

FIG. 1 presents a perspective view of a cleaning system of the present invention showing that an object is supported or held or hung by the cleaning system;

FIG. 2 presents an exploded view of the cleaning system of the present invention;

FIG. 3 presents a perspective view of the cleaning system of the present invention showing that a supporting device of a supporting apparatus of the cleaning system is telescopic;

FIG. 4 presents a perspective view of the cleaning system of the present invention showing that an object is to be held by a holding device of the supporting apparatus of the cleaning system;

FIG. 5 presents a perspective view of the cleaning system of the present invention showing that an object is cleaned by a cleaning apparatus of the cleaning system;

FIG. 6 presents a side view of the cleaning system of the present invention showing that an object is supported or held or hung by the cleaning system;

FIG. 7 presents a cross-sectional view of the cleaning apparatus of the cleaning system of the present invention; and FIG. 8 presents a perspective view of the supporting device and a transporting device of the supporting apparatus of the cleaning system of the present invention showing that the supporting device and the transporting device are foldable or collapsible.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring initially to FIGS. 1-8, the present invention is related to a cleaning system 100 for cleaning an object, such as a rug, a mat, a runner, a curtain or a cloth, which might be too large for standard washing machines.

In an embodiment of the present invention, the cleaning system 100 comprises a supporting apparatus 102 and a cleaning apparatus 104.

In this embodiment of the present invention, the supporting apparatus 102 is configured to support or hold or hang in place an object, such as a rug, a mat, a runner, a curtain or a cloth, to be cleaned by the cleaning apparatus 104.

In this embodiment of the present invention, the cleaning apparatus 104 is configured to provide liquid, fluid, gel or gas, such as water, detergent, solution (solute and solvent) or steam, for cleaning an object, such as a rug, a mat, a runner, a curtain or a cloth, that is supported or held or hung by the supporting apparatus 102.

Accordingly, the supporting apparatus 102 is able to lift an object off of a ground surface, while the cleaning apparatus 104 is cleaning the object and after the object has been cleaned by the cleaning apparatus 104, such that the object could be easily cleaned and quickly dried and is prevented from being contaminated by a ground surface.

In this embodiment of the present invention, the cleaning apparatus 104 is connected with the supporting apparatus 102. In an aspect of this embodiment of the present invention, the cleaning apparatus 104 is permanently mounted on the supporting apparatus 102. In another aspect of this embodiment of the present invention, the cleaning apparatus 104 is removably mounted on the supporting apparatus 102.

In this embodiment of the present invention, the supporting apparatus 102 comprises a supporting device or frame 106, a holding device 108 and a transporting device 110.

In this embodiment of the present invention, the supporting device 106 is telescopic by any telescopic means for easy storage of the cleaning system 100 and other purposes, for example, lifting an object off of a ground surface at a higher level, or for facilitating operation of the cleaning apparatus 104 by a user. For example, the supporting device 106 may comprise two vertical frame elements 116 and a height adjustable module 118, the two vertical frame elements 116 are movably connected with each other, the height adjustable module 118 is connected in between the two vertical frame elements 116 so as to adjust an overall height of the two vertical frame elements 116. In an aspect of this embodiment of the present invention, the height adjustable module 118 is a mechanical module, such as a lifting lever. In another aspect of this embodiment of the present invention, the height adjustable module 118 is an electrical module. In a further aspect of this embodiment of the present invention, the height adjustable module 118 is an electromechanical module.

In this embodiment of the present invention, the supporting device 106 is foldable or collapsible for easy storage of the cleaning system 100 and any other purposes.

In this embodiment of the present invention, the holding device 108 is connected with the supporting device 106. In an aspect of this embodiment of the present invention, the holding device 108 is permanently mounted on the supporting device 106. In another aspect of this embodiment of the present invention, the holding device 108 is removably mounted on the supporting device 106. The holding device 108, as shown in FIG. 5, holding the object in tension.

In this embodiment of the present invention, the holding device 108 is configured to hold in place an object on the supporting device 106. The holding device 108 is mounted on any portion of the supporting device 106. Preferably, the holding device 108 is mounted on a top side of the supporting device 106, such that the holding device 108 is able to hold or grasp a top section of the object and thus hanging the object on the supporting device 106; additionally, the holding device 108 is further mounted on a bottom side of the supporting device 106 to hold or clamp a bottom section of the object, so as to prevent the object from swinging. Additionally or alternatively, the holding device 108 may be mounted on one lateral side or two opposite lateral sides of the supporting device 106. For example, the holding device 108 comprises at least one clip. In an exemplary embodiment, the holding device 108 may include a clip and spring member that holds the object in tension (FIG. 5).

In this embodiment of the present invention, the transporting device 110 is connected with the supporting device 106. In an aspect of this embodiment of the present invention, the transporting device 110 is permanently mounted on the supporting device 106. In another aspect of this embodiment of the present invention, the transporting device 110 is removably mounted on the supporting device 106. Additionally, the transporting device 110 might be foldably mounted on the supporting device 106.

In this embodiment of the present invention, the transporting device 110 is configured to transport the supporting device 106 for easy transportation of the cleaning system 100 on a ground surface and any other purposes. In an aspect of this embodiment of the present invention, the transporting device 110 comprises at least one wheel. The at least one wheel are, for instance, a plurality of wheels. In another aspect of this embodiment of the present invention, the transporting device 110 comprises at least one track. The at least one track are, for instance, a plurality of tracks. In a further aspect of this embodiment of the present invention, the transporting device 110 is a combination of at least one wheel and at least one track.

In this embodiment of the present invention, the cleaning apparatus 104 is connected with the supporting device 106. In an aspect of this embodiment of the present invention, the cleaning apparatus 104 is permanently mounted on the supporting device 106. In another aspect of this embodiment of the present invention, the cleaning apparatus 104 is removably mounted on the supporting device 106.

In an aspect of this embodiment of the present invention, the cleaning apparatus 104 and the transporting device 110 are oppositely located to each other. Specifically, the cleaning apparatus 104 and the transporting device 110 are respectively mounted on two opposite sides of the supporting device 106. For example, the transporting device 110 is mounted on a bottom side, such as a bottom horizonal frame element, of the supporting device 106 while the cleaning apparatus 104 is mounted on a top side, such as a top horizonal frame element, of the supporting device 106.

In another aspect of this embodiment of the present invention, the cleaning apparatus 104 and the transporting device 110 are adjacently located to each other. Specifically, the cleaning apparatus 104 and the transporting device 110 are respectively mounted on two adjacent sides of the supporting device 106. For example, the transporting device 110 is mounted on a bottom side, such as a bottom horizonal frame element, of the supporting device 106 while the cleaning apparatus 104 is mounted on a lateral side, such as a vertical frame element, of the supporting device 106.

In this embodiment of the present invention, the cleaning apparatus 104 comprises a spray device 112 and a manifold device 114.

In this embodiment of the present invention, the spray device 112 is mounted on the supporting device 106.

In this embodiment of the present invention, the spray device 112 and the manifold device 114 are in fluid or gaseous communication with each other.

In this embodiment of the present invention, the manifold device 114 is configured to deliver or transmit cleaning fluid or gas from a supply to the spray device 112. The supply may come from an external fluid system, such as a water reservoir, a water spigot, or the like that may include cleaning chemicals mixed with the fluid.

In this embodiment of the present invention, the spray device 112 is configured to spray, deliver or transmit fluid or gas to an object, such as a rug, a mat, a runner, a curtain or a cloth, that is supported or held or hung by the supporting apparatus 102.

In this embodiment of the present invention, the spray device 112 might comprise a tube and at least one aperture. The tube has a chamber. The at least one aperture traverses into the tube and is in communication with the chamber. In this embodiment of the present invention, the manifold device 114 also traverses into the tube and is in communication with the chamber. Accordingly, cleaning fluid or gas is able to be delivered or transmitted from a supply, through the manifold device 114, and then sprayed by the spray device 112 to an object, such as a rug, a mat, a runner, a curtain or a cloth, that is supported or held or hung by the supporting apparatus 102.

In an aspect of this embodiment of the present invention, the manifold device 114 traverses into a terminal end of the tube, while the at least one aperture traverses into a lateral side of the tube.

In an aspect of this embodiment of the present invention, the at least one aperture are a plurality of apertures, and the plurality of apertures traverse into two lateral sides of the tube and are in communication with the chamber.

Accordingly, the cleaning system 100 may allow a user to hang an object, such as a rug, a mat, a runner, a curtain or a cloth, in a vertical arrangement on the supporting apparatus 102, while engaging the cleaning apparatus 104 to rinse and clean the object.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An object cleaning system, comprising:

a supporting apparatus including a support frame and a transportation frame, the support frame transportable relative to a ground surface by the transportation frame, the support frame comprising a support frame portion allowing a wrapping thereover of a portion of an object to be cleaned;

a cleaning apparatus positionable in a mounted configuration in which the cleaning apparatus is supported by the supporting apparatus adjacent to the support frame portion; and one or more holding devices, wherein the one or more holding devices hold both the object having said portion wrapped around the support frame portion and the cleaning apparatus in the mounted configuration in place while the cleaning apparatus dispenses a cleaning fluid onto the object; wherein the one or more holding devices comprise at least one first holding device, wherein each first holding device of the at least one first holding device is mountable onto the support frame portion over said portion of said object arranged wrapped around the support frame portion to simultaneously secure both the cleaning apparatus in said mounted configuration and said portion of the object to the support frame portion the cleaning apparatus includes a plurality of sprayers, wherein, in the mounted configuration of the cleaning apparatus, the plurality of sprayers extend along said portion of said object to be cleaned; and the support frame portion is elongate and straight, and the cleaning apparatus is elongately formed along a longitudinal direction, and further wherein the at least one first holding device includes two or more first holding devices arranged in spaced-apart configuration along the longitudinal direction of the cleaning apparatus, wherein the longitudinal direction of the cleaning apparatus in the mounted configuration is parallel to the support frame portion.

2. The cleaning system of claim 1, wherein the cleaning apparatus in the mounted configuration is removably affixed to the support frame portion.

3. The cleaning system of claim 1, wherein the support frame is removably mounted to the transportation frame.

4. The cleaning system of claim 1, wherein the transportation frame includes one or more wheels for selectively moving the cleaning system from one location to another.

5. The cleaning system of claim 1, wherein the cleaning apparatus includes a spray device in communication with a manifold device.

6. The cleaning system of claim 1, wherein the supporting apparatus includes a pair of adjustable vertical frame elements and a height-adjusting module for adjusting the vertical frame element's length to adjust an elevation of the support frame portion with respect to a ground.

7. The cleaning system of claim 6, wherein the vertical frame elements are telescopic vertical frames.

8. The cleaning system of claim 1, wherein the supporting apparatus is foldable or collapsible.

9. The cleaning system of claim 1, wherein the one or more holding devices further include one or more spring elements that hold the object in tension when the portion of the object is wrapped around the support frame portion and the cleaning apparatus is secured in the mounted configuration.

10. The cleaning system of claim 1, wherein the cleaning apparatus is removably connected to an external fluid system.

11. The cleaning system of claim 1, wherein the object is a rug, mat, runner, curtain, or cloth.

12. The cleaning system of claim 1, wherein the support frame retains the object in place in a vertical arrangement.

13. The object cleaning system of claim 1, wherein the support frame comprises an upper crossbar member, the upper crossbar member providing the support frame portion, such that the object to be cleaned extends downward from said upper crossbar member.

14. The object cleaning system of claim 13, wherein the support frame further comprises a lower crossbar member and a pair of vertical frame elements extending between the upper and lower crossbar members to define a cleaning area between the upper crossbar member, the lower crossbar member and the pair of vertical frame elements.

15. The object cleaning system of claim 14, wherein the vertical frame elements are height-adjustable to vary a size of the cleaning area.

16. The object cleaning system of claim 14, wherein the one or more holding devices are disposed about the support frame and hold the object in place in the cleaning area while the cleaning apparatus secured in the mounted configuration dispenses a cleaning fluid onto the object.

17. The cleaning system of claim 14, wherein the one or more holding devices include one or more spring elements that hold the object in tension in the cleaning area.

18. The cleaning system of claim 17, wherein the one or more spring elements are provided at the lower crossbar member.

* * * * *